US012152309B2

(12) United States Patent
Chen et al.

(10) Patent No.: US 12,152,309 B2
(45) Date of Patent: Nov. 26, 2024

(54) ENERGY-SAVING SYSTEM AND METHOD FOR EXTRACTING TITANIUM

(71) Applicant: ZHEJIANG HAIHONG HOLDING GROUP CO., LTD., Hangzhou (CN)

(72) Inventors: Haixian Chen, Hangzhou (CN); Jiapei Cao, Hangzhou (CN)

(73) Assignee: ZHEJIANG HAIHONG HOLDING GROUP CO., LTD., Hangzhou (CN)

( * ) Notice: Subject to any disclaimer, the term of this patent is extended or adjusted under 35 U.S.C. 154(b) by 744 days.

(21) Appl. No.: 17/426,114

(22) PCT Filed: Dec. 11, 2019

(86) PCT No.: PCT/CN2019/124493
§ 371 (c)(1),
(2) Date: Jul. 28, 2021

(87) PCT Pub. No.: WO2021/036092
PCT Pub. Date: Mar. 4, 2021

(65) Prior Publication Data

US 2022/0119968 A1 Apr. 21, 2022

(30) Foreign Application Priority Data

Aug. 30, 2019 (CN) ..... 20191082115.7

(51) Int. Cl.
*C25C 3/00* (2006.01)
*C25C 3/28* (2006.01)
*C25C 7/06* (2006.01)

(52) U.S. Cl.
CPC . *C25C 3/28* (2013.01); *C25C 7/06* (2013.01)

(58) Field of Classification Search
CPC ..... C25C 3/00; C25C 3/28; C25C 7/06
See application file for complete search history.

(56) References Cited

U.S. PATENT DOCUMENTS 4,472,202 A * 9/1984 Nielsen ..... C04B 7/00 106/761
2004/0194574 A1* 10/2004 Cardarelli ..... C25C 3/00 205/400
2005/0166706 A1* 8/2005 Withers ..... C25C 3/32 205/560
2016/0222533 A1* 8/2016 Zhu ..... C25C 3/28

* cited by examiner

*Primary Examiner* — Zulmariam Mendez
(74) *Attorney, Agent, or Firm* — Bayramoglu Law Offices LLC

(57) ABSTRACT

The system includes a raw material predrying kiln, a preheating kiln, a reduction rotary kiln, a cooling rotary kiln, a ball mill, a magnetic separator, a reduced iron powder drying kiln, a blank prefabricator, a blank drying kiln, a sintering furnace, a fused salt electrolysis tank, a titanium cleaning device, a filtering device, a vacuum dryer, a waste heat boiler, and a steam turbine generator. In the present disclosure, a high-temperature flue gas produced by the reduction rotary kiln is directly used to preheat a raw material. The CO-containing high-temperature flue gas discharged by the reduction rotary kiln and the CO discharged at the fused salt electrolysis stage are recovered and used for power generation and steam production of the waste heat boiler. Due to a low moisture content of the flue gas, a low-temperature flue gas obtained after the waste heat recovery is used for drying.

13 Claims, 1 Drawing Sheet

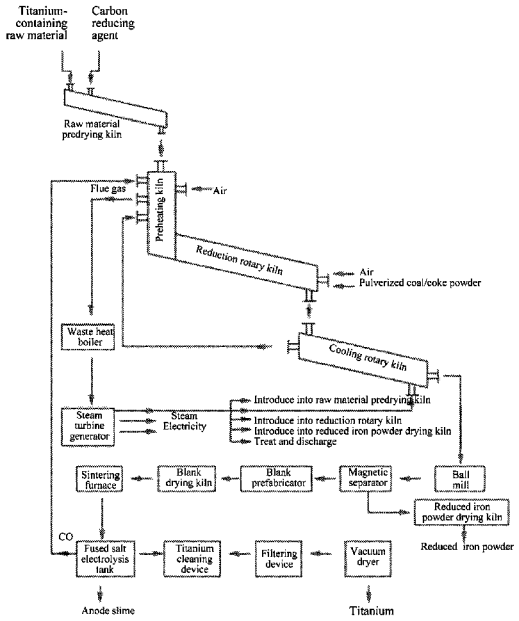

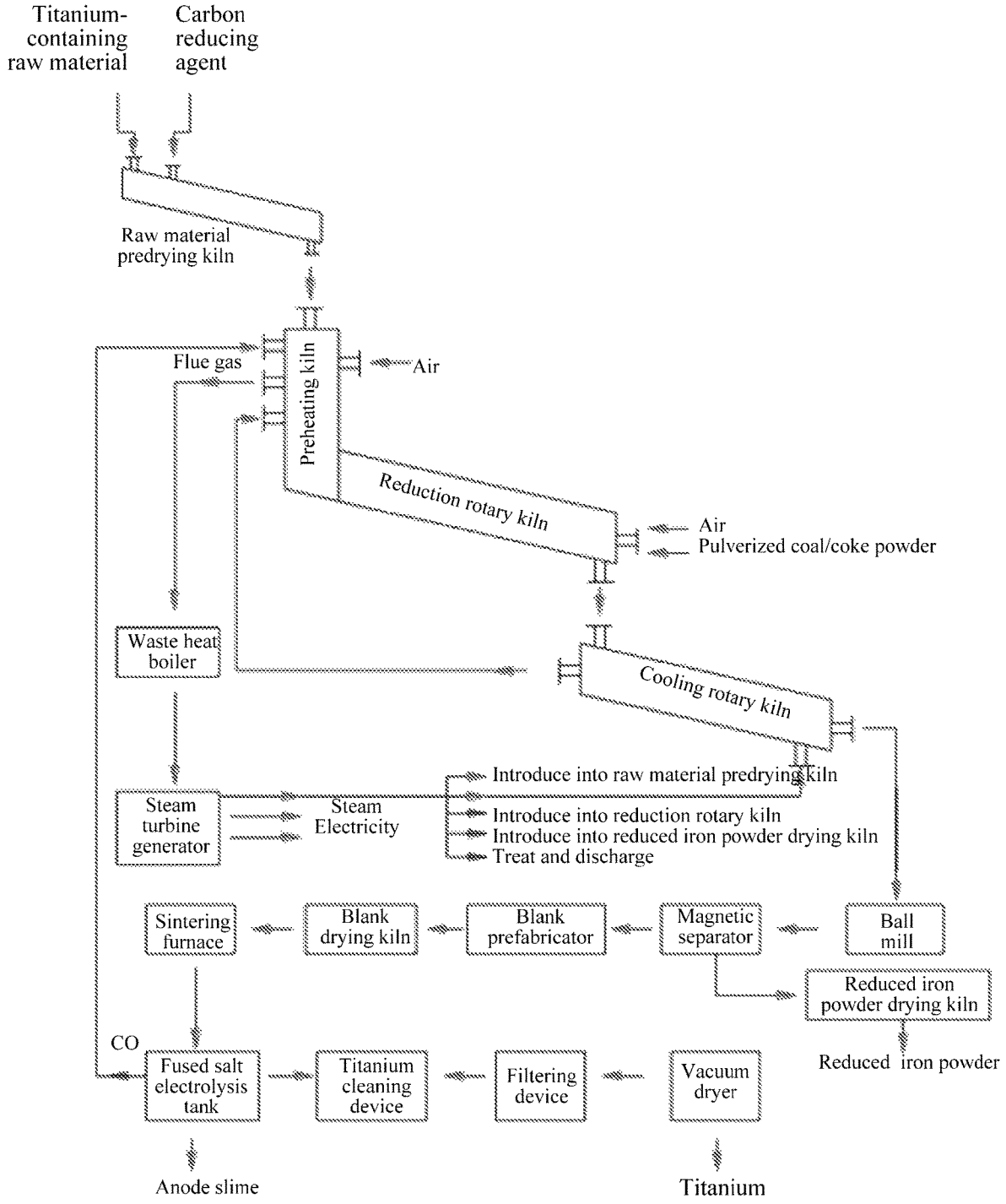
Titanium-containing raw material
Carbon reducing agent
Raw material predrying kiln
Flue gas
Preheating kiln
Air
Reduction rotary kiln
Air
Pulverized coal/coke powder
Waste heat boiler
Cooling rotary kiln
Steam turbine generator
Steam
Electricity
Introduce into raw material predrying kiln
Introduce into reduction rotary kiln
Introduce into reduced iron powder drying kiln
Treat and discharge
Sintering furnace
Blank drying kiln
Blank prefabricator
Magnetic separator
Ball mill
Reduced iron powder drying kiln
CO
Fused salt electrolysis tank
Titanium cleaning device
Filtering device
Vacuum dryer
Reduced iron powder
Anode slime
Titanium

ENERGY-SAVING SYSTEM AND METHOD FOR EXTRACTING TITANIUM

CROSS REFERENCE TO THE RELATED APPLICATIONS

This application is the national phase entry of International Application No. PCT/CN2019/124493, filed on Dec. 11, 2019, which is based upon and claims priority to Chinese Patent Application No. 201910521157.3, filed on Aug. 30, 2019, the entire contents of which are incorporated herein by reference.

TECHNICAL FIELD

The present disclosure belongs to the field of non-ferrous metal metallurgy, and specifically relates to an energy-saving system and method for extracting titanium.

BACKGROUND

Titanium is a metal with very superior properties, having the advantages of low specific gravity, high specific strength, excellent corrosion resistance, etc. The Kroll process is an existing industrial production method of titanium, in which a $TiO_2$ ore is chlorinated in the presence of carbon to obtain $TiCl_4$, and then $TiCl_4$ reacts with magnesium to produce sponge titanium. The Kroll process is complex, and the $TiCl_4$ purification, $TiCl_4$ reduction, titanium separation at a high temperature, and $MgCl_2$ purification in this process are time-consuming and highly energy-wasting.

There are many preparation methods for titanium, wherein the typical methods include the FFC process proposed by the Cambridge University in England, the PRP process proposed by Okabe in Japan, and the fluorotitanate reduction method. However, these methods cannot overcome the existing technical problems and thus fail to industrialize the production of titanium.

In addition, the electrolytic processes for preparing titanium use a soluble anode to prepare titanium. In the 1950s, U.S. Pat. No. 2,722,509 disclosed the fused salt electrolysis, where an anode is made of TiO and carbon and titanium is separated at a cathode. Chinese Patent No. CN104831318B disclosed a thermal-electrochemical method for preparing a metal, where a mixture of titanium oxide and carbon reacted at 1,100° C. to 1,300° C. to obtain a composite of TiO and TiC, and the composite was used as an electrolytic anode for titanium extraction. Chinese Patent No. CN100415940C disclosed a method for preparing pure titanium by electrolysis with a titanium monoxide/titanium carbide soluble solid solution anode, where a composite of TiO and TiC was used as an anode to prepare titanium by electrolysis. Chinese Patent No. CN103451682B disclosed a fused salt electrolysis method for extracting titanium with a titanium-containing soluble anode, where a titanium-containing material and carbon reacted in a nitrogen-containing atmosphere to prepare titanium carbon oxynitride, and the titanium carbon oxynitride was used as an anode for fused salt electrolysis. Chinese Patent No. CN102925930B disclosed a method for preparing titanium using a titanium-containing material, where a composite of a titanium-containing material and carbon was used as an anode to prepare titanium by two-step electrolysis.

The existing fused salt electrolysis processes for extracting titanium have the following shortcomings:

1. Anode materials need to be prepared using a vacuum furnace, muffle furnace, and other batching devices, which has low production efficiency.

2. CO-containing high-temperature flue gas discharged during the preparation of anode materials and CO discharged during an electrolysis process are not recycled, resulting in high energy consumption.

3. Multiple process steps of an existing fused salt electrolysis process for extracting titanium require additional energy consumption to dry raw materials, blanks, and reduced iron powder, resulting in high energy consumption.

Therefore, in order to improve the production efficiency and reduce the production energy consumption during a fused salt electrolysis process for preparing titanium powder, the present disclosure proposes an energy-saving system and method for extracting titanium.

SUMMARY

An objective of the present disclosure is to provide an energy-saving system for extracting titanium to solve the shortcomings of the prior art.

Another objective of the present disclosure is to provide an energy-saving method for extracting titanium to solve the shortcomings of the prior art.

The present disclosure adopts the following technical solutions to solve the technical problems:

The present disclosure provides an energy-saving system for extracting titanium, including a raw material predrying kiln, a preheating kiln, a reduction rotary kiln, a cooling rotary kiln, a ball mill, a magnetic separator, a reduced iron powder drying kiln, a blank prefabricator, a blank drying kiln, a sintering furnace, a fused salt electrolysis tank, a titanium cleaning device, a filtering device, a vacuum dryer, a waste heat boiler, and a steam turbine generator, where an outlet of the raw material predrying kiln communicates with a space in a top inlet of the preheating kiln; a bottom outlet of the preheating kiln communicates with a space at a kiln tail of the reduction rotary kiln; an outlet at a kiln head of the reduction rotary kiln communicates with a space in an inlet at a kiln tail of the cooling rotary kiln; an outlet at a kiln head of the cooling rotary kiln is connected to the ball mill, the magnetic separator, the blank prefabricator, the blank drying kiln, the sintering furnace, the fused salt electrolysis tank, the titanium cleaning device, the filtering device, and the vacuum dryer in sequence; the reduced iron powder drying kiln communicates with a space in an iron powder discharge port of the magnetic separator; a CO outlet of the fused salt electrolysis tank communicates with a space in a CO inlet of the preheating kiln; a flue gas outlet of the preheating kiln communicates with a space in a flue gas inlet of the waste heat boiler; a steam outlet of the waste heat boiler communicates with a space in a steam inlet of the steam turbine generator; a flue gas outlet of the waste heat boiler communicates with spaces in flue gas inlets of the raw material predrying kiln, the cooling rotary kiln, the blank drying kiln, and the reduced iron powder drying kiln; and a flue gas outlet of the cooling rotary kiln communicates with a space in a flue gas inlet of the preheating kiln.

Preferably, the reduction rotary kiln may have a diameter of 1 m to 8 m and a length of 30 m to 150 m, and a kiln lining may be made of a high-temperature: resistant material. Preferably, the reduction rotary kiln may have a length of 60 m to 120 m.

Preferably, the sintering furnace may be a vacuum furnace, a graphitization furnace, a tunnel kiln, or a muffle furnace.

The present disclosure also provides an energy-saving method for extracting titanium based on the system, including the following steps:

S1. Predrying and Preheating of a Raw Material adding a titanium-containing, raw material and a carbon reducing agent to an inlet at a kiln tail of the raw material predrying kiln, and at the same time, introducing a low-temperature flue gas (150° C. to 300° C.) from the waste heat boiler into a kiln head of the raw material predrying kiln, such that the raw material and the low-temperature flue gas flow in opposite directions in the raw material predrying kiln; predrying the raw material to a moisture content of less than 5% wt; transferring a predried raw material into a top inlet of the preheating kiln, and at the same time, introducing a high-temperature mixed flue gas from downstream into a bottom of the preheating kiln, and supplementing air to burn out carbon and/or CO in the flue gas and release chemical heat, such that the raw material and the high-temperature mixed flue gas flow in opposite directions; and preheating the raw material to 600° C. to 1,300° C., where the high-temperature mixed flue gas is at least one from the group consisting of a high-temperature reduction flue gas (1,100° C. to 1,600° C.) from the downstream reduction rotary kiln, a flue gas (500° C. to 1,300° C.) obtained after cooling and heating of the cooling rotary kiln, and a CO (400° C. to 700° C.) from the downstream fused salt electrolysis tank; a high-temperature mixed flue gas outlet has a temperature of 700° C. to 1,500° C.;

the titanium-containing raw material is any one from the group consisting of high-titanium slag, rutile, artificial rutile, titanium dioxide, titanium concentrate, leucoxene, and anatase, and the carbon reducing agent is any one from the group consisting of coal, petroleum coke, coke, and graphite;

S2. Reduction of the Titanium-Containing Raw Material transferring a preheated raw material into the kiln tail of the reduction rotary kiln, and injecting a pulverized coal fuel and air at the kiln head of the reduction rotary kiln to form a high-temperature air flow (1,100° C. to 1,600° C.) in the kiln; driving the raw material to slowly move towards the kiln head through a rotation of the reduction rotary kiln, such that the raw material is gradually heated by high-temperature air flow radiation, and $TiO_2$ in the titanium-containing raw material is reduced by the carbon reducing agent into titanium oxycarbide ($TiC_xO_y$, 0<x, y<1) and titanium carbon oxynitride ($TiC_xO_yN_z$, 0<x, y, z<1), with by-products of reduced iron powder and CO; transferring a solid material with a temperature of 1,000° C. to 1,500° C. into the cooling rotary kiln; and introducing the CO produced during the reaction into the preheating kiln along with a flue gas;

S3. Cooling of the Solid Material transferring the solid material of 1,000° C. to 1,500° C. into the kiln tail of the cooling rotary kiln, and at the same time, introducing a low-temperature flue gas (150° C. to 300° C.) from the waste heat boiler at the kiln head of the cooling rotary kiln to cool the solid material, where a material outlet has a temperature of 250° C. to 400° C. and a flue gas outlet has a temperature of 700° C. to 1,200° C.;

S4. Sinter Molding of a Fused Salt Electrolysis Anode mixing a cooled solid material with water, and milling a resulting mixture in the ball mill to a particle size of 100 to 800 mesh; transferring a milled material into the magnetic separator to separate the reduced iron powder, and transferring the reduced iron powder into the reduced iron powder drying kiln to obtain a by-product of reduced iron powder; subjecting the remaining titanium oxycarbide and titanium carbon oxynitride material to compression molding in the blank prefabricator to obtain a fused salt electrolysis anode blank, and drying the blank in the blank drying kiln for 4 h to 12 h; and sintering a dried blank in the sintering furnace; where the reduced iron powder drying kiln and the blank drying kiln use a low-temperature flue gas (150° C. to 300° C.) from the waste heat boiler for drying, there is no oxygen in the sintering furnace, and the sintering is conducted at 800° C. to 1,800° C. for 2 h to 12 h;

S5. Preparation of Titanium by Fused Salt Electrolysis electrolyzing the anode obtained from sinter molding in the fused salt electrolysis tank, such that the anode is dissolved, $Ti^{2+}$, $Ti^{3+}$, and CO; discharging anode impurities from the electrolysis tank in the form of anode slime; introducing the CO of 400° C. to 700° C. into the preheating kiln for recycling such that titanium is separated at a metal cathode from the $Ti^{2+}$ and $Ti^{3+}$; and cooling collected titanium to below 150° C., cleaning in the titanium cleaning device to remove entrained inorganic salts, filtering out titanium in the filtering device, and drying in the vacuum dryer to obtain a titanium product.

Preferably, the present disclosure may also include waste heat recovery and comprehensive utilization of low-temperature flue gas. Specifically:

A high-temperature flue gas in the reduction rotary kiln first enters the preheating kiln to heat a raw material; a flue gas of 700° C. to 1,500° C. discharged from the preheating kiln enters the waste heat boiler to produce steam, and the steam drives the steam turbine generator to generate electricity and a by-produce of low-pressure steam; and a lode-temperature flue gas of 150° C. to 300° C. discharged from the waste heat boiler is used for the drying of the raw material predrying kiln, the blank drying kiln, and the reduced iron powder drying kiln, and is also used to cool a solid material in the cooling rotary kiln and recover sensible heat of the solid material.

Preferably, in S1, the titanium-containing raw material may have a particle size of 80 to 600 mesh, a $TiO_2$ content of more than 30% wt, and a moisture content of less than 10% wt; and the carbon reducing agent may have a particle size of 10 to 200 mesh, a fixed carbon content of more than 70% wt, and a moisture content of less than 10% wt.

Preferably, in S1, the reduction rotary kiln may have a rotational speed of 0.2 r/min to 5 r/min, and the titanium-containing raw material and the carbon reducing agent may stay in the reduction rotary kiln for 2 h to 12 h.

Preferably, in S4, the titanium oxycarbide and titanium carbon oxynitride material separated by the magnetic separator may be added with one or a combination of two or more from the group consisting of sodium carboxymethyl cellulose ((CMC-Na), polyacrylic acid (PAA), aluminum dihydrogen phosphate, silica sol, and aluminum sol, with an addition proportion of 0.5% wt to 15% wt.

Preferably, in S4, the compression molding for the blank may be conducted at a pressure of 20 MPa to 200 MPa, and the blank may have a granular, plate or cylindrical shape.

Preferably, in S5, the fused salt electrolysis may be conducted at a current density of 0.05 $A/cm^2$ to 1.2 $A/cm^2$; a cathode material may be titanium, titanium alloy, carbon steel, stainless steel, aluminum, aluminum alloy, chromium, molybdenum, magnesium, or copper; a fused salt may include one or a combination of two or more from the group consisting of LiCl, NaCl, KCl, $MgCl_2$, and $CaCl_2$; and the fused salt electrolysis may be conducted at a temperature of 400° C. to 700° C.

The present disclosure has the following beneficial effects:

1. In the present disclosure, a high-temperature flue gas produced by the reduction rotary kiln is directly used to preheat a raw material to 600° C. to 1,300° C., which achieves waste heat recovery, shortens the heating time for the raw material in the reduction rotary kiln subsequently, and improves the production capacity of the reduction rotary kiln.

2. The CO-containing high-temperature flue gas discharged by the reduction rotary kiln and the CO discharged at the fused salt electrolysis stage are recovered and used for power generation and steam production of the waste heat boiler, which reduces the energy consumption of the system.

3. Due to a low moisture content of the flue gas, a low-temperature flue gas obtained after the waste heat recovery is used for the drying of the raw material predrying kiln, the blank drying kiln, and the reduced iron powder drying kiln, and is also used to cool a solid material in the cooling rotary kiln and recover sensible heat of the solid material, which improves the energy efficiency.

4. The raw material predrying kiln, reduction rotary kiln, and cooling rotary kiln for continuous production are used, resulting in high production efficiency.

BRIEF DESCRIPTION OF THE DRAWINGS

FIG. 1 is a schematic diagram of the energy-saving system for extracting titanium.

DETAILED DESCRIPTION OF THE EMBODIMENTS

The examples of the present disclosure are described in detail below, but the present disclosure can be implemented in various different modes limited and involved by the claims.

As shown in FIG. 1, an energy-saving system for extracting titanium includes a raw material predrying kiln, a preheating kiln, a reduction rotary kiln, a cooling rotary kiln, a ball mill, a magnetic separator, a reduced iron powder drying kiln, a blank prefabricator, a blank drying kiln, a sintering furnace, a fused salt electrolysis tank, a titanium cleaning device, a filtering device, a vacuum dryer, a waste heat boiler, and a steam turbine generator. An outlet of the raw material predrying kiln communicates with a space in a top inlet of the preheating kiln (a specific spatial communication manner in the prior art, (such as pipeline communication and chamber communication) may be selected to realize the circulation of a material or a medium (including flue gas and steam) among different units or devices, and the spatial communication described below is understood in the same way); a bottom outlet of the preheating kiln communicates with a space at a kiln tail of the reduction rotary kiln; an outlet at a kiln head of the reduction rotary kiln communicates with a space in an inlet at a kiln tail of the cooling rotary kiln; an outlet at a kiln head of the cooling rotary kiln is connected to the ball mill, the magnetic separator, the blank prefabricator, the blank drying kiln, the sintering furnace, the fused salt electrolysis tank, the titanium cleaning device, the filtering device, and the vacuum dryer in sequence; the reduced iron powder drying kiln communicates with a space in an iron powder discharge port of the magnetic separator; a CO outlet of the fused salt electrolysis tank communicates with a space in a CO inlet of the preheating kiln; a flue gas outlet of the preheating kiln communicates with a space in a flue gas inlet of the waste heat boiler; a steam outlet of the waste heat boiler communicates with a space in a steam inlet of the steam turbine generator; a flue gas outlet of the waste heat boiler communicates with spaces in flue gas inlets of the raw material predrying kiln, the cooling rotary kiln, the blank drying kiln, and the reduced iron powder drying kiln; and a flue gas outlet of the cooling rotary kiln communicates with a space in a flue gas inlet of the preheating kiln.

In the present disclosure, specifically, the reduction rotary kiln may have a diameter of 1 m to 8 m and a length of 30 m to 150 m, and a kiln lining may be made of a high-temperature resistant material, such as any one from the group consisting of magnesium-alumina brick, fireclay refractory brick, high alumina brick, and silica brick. The diameter and length of the kiln should be selected according to the actual design capacity, and a specific high-temperature resistant material used for the kiln lining is a conventional material.

Considering the actual production situation, as a preferred solution, the reduction rotary kiln may have a length of 60 m to 120 m. With a length within this range, a solution for titanium processing that is more in line with the actual production needs can be obtained.

In the present disclosure, the sintering furnace may be a vacuum furnace, a graphitization furnace, a tunnel kiln, or a muffle furnace.

The present disclosure also provides an energy-saving method for extracting titanium based on the system, including the following steps:

S1. Predrying and Preheating of a Raw Material adding a titanium-containing, raw material and a carbon reducing agent to an inlet at a kiln tail of the raw material predrying kiln, and at the same time, introducing a low-temperature flue gas (150° C. to 300° C.) from the waste heat boiler into a kiln head of the raw material predrying kiln, such that the raw material and the low-temperature flue gas flow in opposite directions in the raw material predrying kiln; predrying the raw material to a moisture content of less than 5% wt; transferring a predried raw material into a top inlet of the preheating kiln, and at the same time, introducing a high-temperature mixed flue gas from downstream into a bottom of the preheating kiln, and supplementing air to burn out carbon and/or CO in the flue gas and release chemical heat, such that the raw material and the high-temperature mixed flue gas flow in opposite directions; and preheating the raw material to 600° C. to 1,300° C., where the high-temperature mixed flue gas is at least one from the group consisting of a high-temperature reduction flue gas (1,100° C. to 1,600° C.) from the downstream reduction rotary kiln, a flue gas (500° C. to 1,300° C.) obtained after cooling and heating of the cooling rotary kiln, and a CO (400° C. to 700° C.) from the downstream fused salt electrolysis tank; a high-temperature mixed flue gas outlet has a temperature of 700° C. to 1,500° C.;

the titanium-containing raw material is any one from the group consisting of high-titanium slag, rutile, artificial rutile, titanium dioxide, titanium concentrate, leucoxene, and anatase, and the carbon reducing agent is any one from the group consisting of coal, petroleum coke, coke, and graphite;

S2. Reduction of the Titanium-Containing Raw Material transferring a preheated raw material into the kiln tail of the reduction rotary kiln, and injecting a pulverized coal fuel and air at the kiln head of the reduction rotary kiln to form a high-temperature air flow (1,100° C. to 1,600° C.) in the kiln; driving the raw material to slowly move towards the kiln head through a rotation of the reduction rotary kiln, such that the raw material is gradually heated by high-temperature air flow radiation, and $TiO_2$ in the titanium-containing raw material is reduced by the carbon reducing agent into titanium oxycarbide ($TiC_xO_y$, 0<x, y<1) and titanium carbon oxynitride ($TiC_xO_yN_z$, 0<x, y, z<1), with by-products of reduced iron powder and CO; transferring a solid material with a temperature of 1,000° C. to 1,500° C. into the cooling rotary kiln; and introducing the CO produced during the reaction into the preheating kiln along with a flue gas;

S3. Cooling of the Solid Material transferring the solid material of 1,000° C. to 1,500° C. into the kiln tail of the cooling rotary kiln, and at the same time, introducing a low-temperature flue gas (150° C. to 300° C.) from the waste heat boiler at the kiln head of the cooling rotary kiln to cool the solid material, where a material outlet has a temperature of 250° C. to 400° C. and a flue gas outlet has a temperature of 700° C. to 1,200° C.;

S4. Sinter Molding of a Fused Salt Electrolysis Anode mixing a cooled solid material with water, and milling a resulting mixture in the ball mill to a particle size of 100 to 800 mesh; transferring a milled material into the magnetic separator to separate the reduced iron powder, and transferring the reduced iron powder into the reduced iron powder drying kiln to obtain a by-product of reduced iron powder; subjecting the remaining titanium oxycarbide and titanium carbon oxynitride material to compression molding in the blank prefabricator to obtain a fused salt electrolysis anode blank, and drying the blank in the blank drying kiln for 4 h to 12 h; and sintering a dried blank in the sintering furnace; where the reduced iron powder drying kiln and the blank drying kiln use a low-temperature flue gas (150° C. to 300° C.) from the waste heat boiler for drying, there is no oxygen in the sintering furnace, and the sintering is conducted at 800° C. to 1,800° C. for 2 h to 12 h;

S5. Preparation of Titanium by Fused Salt Electrolysis electrolyzing the anode obtained from sinter molding in the fused salt electrolysis tank, such that the anode is dissolved to obtain $Ti^{2+}$, $Ti^{3+}$, and CO; discharging anode impurities from the electrolysis tank in the form of anode slime; introducing the CO of 400° C. to 700° C. into the preheating kiln for recycling, such that titanium is separated at a metal cathode from the $Ti^{2+}$ and $Ti^{3+}$; and cooling collected titanium to below 150° C., cleaning in the titanium cleaning device to remove entrained inorganic salts, filtering out titanium in the filtering device, and drying in the vacuum dryer to obtain a titanium product.

The present disclosure may also include waste heat recovery and comprehensive utilization of low-temperature flue gas. Specifically:

A high-temperature flue gas in the reduction rotary kiln first enters the preheating kiln to heat a raw material; a flue gas of 700° C. to 1,500° C. discharged from the preheating kiln enters the waste heat boiler to produce steam, and the steam drives the steam turbine generator to generate electricity and a by-produce of low-pressure steam; and a low-temperature flue gas of 150° C. to 300° C. discharged from the waste heat boiler is used for the drying of the raw material predrying kiln, the blank drying kiln, and the reduced iron powder drying kiln, and is also used to cool a solid material in the cooling rotary kiln and recover sensible heat of the solid material.

As a further specific explanation, in S1, the titanium-containing raw material may have a particle size of 80 to 600 mesh, a $TiO_2$ content of more than 30% wt, and a moisture content of less than 10% wt; and the carbon reducing agent may have a particle size of 10 to 200 mesh, a fixed carbon content of more than 70% wt, and a moisture content of less than 10% wt.

In the present disclosure, in S1, the reduction rotary kiln may have a rotational speed of 0.2 r/min to 5 r/min, and the titanium-containing raw material and the carbon reducing agent may stay in the reduction rotary kiln for 2 h to 12 h.

Specifically, in S4, the titanium oxycarbide and titanium carbon oxynitride material separated by the magnetic separator may be added with one or a combination of two or more from the group consisting of CMC-Na, PAA, aluminum dihydrogen phosphate, silica sol, and aluminum sol, with an addition proportion of a 0.5% wt to 15% wt.

In the present disclosure, in S4, the compression molding for the blank may be conducted at a pressure of 20 MPa to 200 MPa, and the blank may have a granular, plate or cylindrical shape.

In the present disclosure, in S5, the fused salt electrolysis may be conducted at a current density of 0.05 $A/cm^2$ to 1.2 $A/cm^2$, a cathode material may be titanium, titanium alloy, carbon steel, stainless steel, aluminum, aluminum alloy, chromium, molybdenum, magnesium, or copper; a fused salt may include one or a combination of two or more from the group consisting of LiCl, NaCl, KCl, $MgCl_2$, and $CaCl_2$; and the fused salt electrolysis may be conducted at a temperature of 400° C. to 700° C.

The Specific Size Selection of a Device and the Process Control Parameters Are Illustrated Below Through Specific Examples

Example 1

As shown in FIG. 1, an energy-saving system for extracting titanium includes a raw material predrying kiln, a preheating kiln, a reduction rotary kiln, a cooling rotary kiln, a ball mill, a magnetic separator, a reduced iron powder drying kiln, a blank prefabricator, a blank drying kiln, a sintering furnace, a fused salt electrolysis tank, a titanium cleaning device, a filtering device, a vacuum dryer, a waste heat boiler, and a steam turbine generator. An outlet of the raw material predrying kiln communicates with a space in a top inlet of the preheating kiln (a specific spatial communication manner in the prior art (such as pipeline communication and chamber communication) may be selected to realize the circulation of a material or a medium (including flue gas and steam) among different units or devices, and the spatial communication described below is understood in the same way); a bottom outlet of the preheating kiln communicates with a space at a kiln tail of the reduction rotary kiln; an outlet at a kiln head of the reduction rotary kiln communicates with a space in an inlet at a kiln tail of the cooling rotary kiln; an outlet at a kiln head of the cooling rotary kiln is connected to the ball mill, the magnetic separator, the blank prefabricator, the blank drying kiln, the sintering furnace, the fused salt electrolysis tank, the titanium cleaning device, the filtering device, and the vacuum dryer in sequence; the reduced iron powder drying kiln communicates with a space in an iron powder discharge port of the magnetic separator; a CO outlet of the fused salt electrolysis tank communicates with a space in a CO inlet of the preheating kiln; a flue gas outlet of the preheating kiln communicates with a space in a flue gas inlet of the waste heat boiler; a steam outlet of the waste heat boiler communicates with a space in a steam inlet of the steam turbine generator; a flue gas outlet of the waste heat boiler communicates with spaces in flue gas inlets of the raw material predrying kiln, the cooling rotary kiln, the blank drying kiln, and the reduced iron powder drying kiln; and a flue gas outlet of the cooling rotary kiln communicates with a space in a flue gas inlet of the preheating kiln.

In Example 1, the reduction rotary kiln has a diameter of 5 m and a length of 80 m, and a kiln lining is made of magnesium-alumina brick.

An energy-saving method for extracting titanium based on the system in Example 1 included the following steps:

S1, Predrying and Preheating of a Raw Material leucoxene and petroleum coke were added to an inlet at a kiln tail of the raw material predrying kiln, and at the same time, a low-temperature flue gas (200° C.) from the waste heat boiler was introduced into a kiln head of the raw material predrying kiln, such that the raw material and the low-temperature flue gas flowed in opposite directions in the raw material predrying kiln; the raw material was predried to a moisture content of less than 3% wt; a predried raw material was transferred into a top inlet of the preheating kiln, and at the same time, a high-temperature mixed flue gas from downstream was introduced into a bottom of the preheating kiln, such that the raw material and the high-temperature mixed flue gas flowed in opposite directions; and air was supplemented in the mixed flue gas to burn out CO and/or entrained carbon in the flue gas and release chemical heat, and the raw material was preheated to 850° C.; where the high-temperature mixed flue gas was a high-temperature reduction flue gas (1,300° C.) from the downstream reduction rotary kiln, a flue gas (800° C.) obtained after cooling and heating of the downstream cooling rotary kiln, and a CO (550° C.) from the downstream fused salt electrolysis tank; and a mixed flue gas outlet had a temperature of 1,050° C.

S2. Reduction of the Titanium-Containing Raw Material a preheated raw material was transferred into the kiln tail of the reduction rotary kiln, and a pulverized coal fuel and air were injected at the kiln head of the reduction rotary kiln to form a high-temperature air flow (1,300° C.) in the kiln; the raw material was driven to slowly move towards the kiln head through a rotation of the reduction rotary kiln, such that the raw material was gradually heated by high-temperature air flow radiation, and $TiO_2$ in the titanium-containing raw material was reduced by the carbon reducing agent into titanium oxycarbide ($TiC_{0.45}O_{0.55}$) and titanium carbon ox nitride ($TiC_{0.2}O_{0.3}N_{0.5}$), with by-products of reduced iron powder and CO; a solid material with a temperature of 1,100° C. would be transferred into the cooling rotary kiln; and the CO produced during the reaction was introduced into the preheating kiln along with a flue gas;

S3. Cooling of the Solid Material the solid material of 1,100° C. was transferred into the kiln tail of the cooling rotary kiln, and at the same time, a low-temperature flue gas (200° C.) from the waste heat boiler was introduced at the kiln head of the cooling rotary kiln to cool the solid material, where a material outlet had a temperature of 300° C. and a flue gas outlet had a temperature of 800° C.;

S4. Sinter Molding of a Fused Salt Electrolysis Anode a cooled solid material was mixed with water, and a resulting mixture was milled in the ball mill to a particle size of 400 mesh; a milled material was transferred into the magnetic separator to separate the reduced iron powder, and the reduced iron powder was transferred into the reduced iron powder drying kiln to obtain a by-product of reduced iron powder; the remaining titanium oxycarbide and titanium carbon oxynitride material was subjected to compression molding in the blank prefabricator to obtain a fused salt electrolysis anode blank, and the blank was dried in the blank drying kiln for 8 h; and a dried blank was sintered in the sintering furnace; where the reduced iron powder drying kiln and the blank drying kiln used a low-temperature flue gas (200° C.) from the waste heat boiler for drying, there was no oxygen in the sintering furnace, the sintering was conducted at 1,700° C. for 4 h, and the sintering furnace was a graphitization furnace;

S5. preparation of titanium by fused salt electrolysis the anode obtained from sinter molding was electrolyzed in the fused salt electrolysis tank, such that the anode was dissolved to obtain $Ti^{2+}$, $Ti^{3+}$, and CO and titanium was separated at a metal cathode from the $Ti^{2+}$ and $Ti^{3+}$; anode impurities were discharged from the electrolysis tank in the form of anode slime; the CO of 450° C. was introduced into the preheating kiln for recycling; and collected titanium was cooled to below 150° C., cleaned in the titanium cleaning device to remove entrained inorganic salts, filtered in the filtering device, and dried in the vacuum dryer to obtain a titanium product.

Example 1 also included waste heat recovery and comprehensive utilization of low-temperature flue gas. Specifically: A high-temperature flue gas in the reduction rotary kiln first entered the preheating kiln to heat a raw material; a flue gas of 1,050° C. discharged from the preheating kiln entered the waste heat boiler to produce steam, and the steam drove the steam turbine generator to generate electricity and a by-produce of low-pressure steam; and a low-temperature flue gas of 200° C. discharged from the waste heat boiler was used for the drying of the raw material predrying kiln, the blank drying kiln, and the reduced iron powder drying kiln, and was also used to cool a solid material in the cooling rotary kiln and recover sensible heat of the solid material.

In example 1 of the present disclosure, in S1, the leucoxene had a particle size of 400 mesh, a $TiO_2$ content of 85% wt, and a moisture content of 6% wt; the carbon reducing agent had a particle size of 100 mesh, a fixed carbon content of 95% wt, and a moisture content of less than 1% wt; the reduction rotary kiln had a rotational speed of 0.5 r/min; and the titanium-containing raw material and carbon reducing agent stayed in the reduction rotary kiln for 4 h.

In S4, a combination of CMC-Na and silica sol was added to the titanium oxycarbide and titanium carbon oxynitride material separated by the magnetic separator, with an addition proportion of 5% wt; the compression molding for the blank was conducted at a pressure of 100 MPa; and the blank had a plate shape.

In S5, the fused salt electrolysis was conducted at a current density of 0.5 A/cm$^2$; a cathode material was stainless steel SUS304; a fused salt was a composition of LiCl, NaCl, and KCl, where the LiCl, NaCl, and KCl had mass proportions of 30%, 40%, and 30%, respectively; and the fused salt electrolysis was conducted at a temperature of 500° C.

The production capacity of the system in Example 1 of the present disclosure was as follows: leucoxene: 2.7 t/h, petroleum coke: 1.5 t/h, and prepared titanium: 1.25 t/h. Elemental analysis results of the obtained titanium were as follows: Ti: 99.30%, C: 0.07%, O: 0.25%, and Fe: 0.26%. 2,000 kWh of electricity was recovered per hour during the power generation by waste heat.

Example 2

Titanium concentrate was used as a titanium-containing raw material, with a particle size of 200 mesh, a $TiO_2$ content of 52% wt, and a moisture content of 5.5% wt, which was used at an amount of 4.35 t/h.

Pulverized coal with a high ash fusion point was used as a carbon reducing agent, with a particle size of 200 mesh, a fixed carbon content of 91% wt, and a moisture content of lower than 2% wt, which was used at an amount of 2.25 t/h.

The sintering furnace was a vacuum furnace, and the sintering was conducted at a temperature of 1,500° C. In S4, a combination of aluminum dihydrogen phosphate and silica sol was added to the titanium oxycarbide and titanium carbon oxynitride material separated by the magnetic separator, with an addition proportion of 6% wt.

The remaining conditions were the same as in Example 1. Experimental result: prepared titanium: 1.2 t/h. Elemental analysis results of the obtained titanium were as follows: Ti: 99.32%, C: 0.06%, O: 0.26%, and Fe: 0.28%. 3,000 kWh of electricity was recovered per hour during the power generation by waste heat.

Example 3

In S1, the reduction rotary kiln had a diameter of 1 m and a length of 30 m, and a kiln lining was made of high alumina brick (a high-temperature resistant material). A low-temperature flue gas of the waste heat boiler had a temperature of 150° C., and a high-temperature reduction flue gas had a temperature of 1,100° C.; the cooling rotary kiln had a temperature of 600° C.; a CO of the fused salt electrolysis tank had a temperature of 400° C.; the raw material was preheated to 600° C.; and a high-temperature mixed flue gas outlet had a temperature of 700° C. High-titanium slag was used as a titanium-containing raw material, with a $TiO_2$ content of 82% wt, a particle size of 80 mesh, and a moisture content of 3.5% wt. Graphite was used as a carbon reducing agent, with a particle size of 10 mesh, a fixed carbon content of 99% wt, and a moisture content of lower than 0.6% wt. The reduction rotary kiln had a rotational speed of 0.2 r/min, and the raw material and the reducing agent stayed M the reduction rotary kiln for 12 h.

In S2, a high-temperature air flow in the kiln had a temperature of 1,100° C., and a material discharged from the kiln had a temperature of 1,000° C.; $TiO_2$ in the titanium-containing raw material was reduced by the carbon reducing agent into titanium oxycarbide ($TiC_{0.5}O_{0.5}$) and titanium carbon oxynitride ($TiC_{0.2}O_{0.34}N_{0.46}$).

In S3, a material outlet had a temperature of 250° C., and a flue gas outlet had a temperature of 700° C.

In S4, the sintering furnace was a tunnel kiln, and the sintering was conducted at 800° C. for 12 h; a combination of PAA, aluminum dihydrogen phosphate, and aluminum sol was added to the titanium oxycarbide and titanium carbon oxynitride material separated by the magnetic separator, with an addition proportion of 0.25%; and the molding was conducted at a pressure of 20 Mpa.

In S5, the fused salt electrolysis was conducted at a current density of 0.05 $A/cm^2$ and a temperature of 400° C.; a cathode material was titanium; and the fused salt was a composition of LiCl and $MgCl_2$, where the LiCl and $MgCl_2$ had mass proportions of 60% and 40%, respectively.

The remaining conditions were the same as in Example 1. The production capacity of the system in Example 3 of the present disclosure was as follows: titanium-containing raw material: 200 kg/h, carbon reducing agent: 320 kg/h, and prepared titanium: 80 kg/h. An elemental analysis result of the obtained titanium was as follows: Ti: 99.41%. 400 kWh of electricity was recovered per hour during the power generation by waste heat.

Example 4

In S1, the reduction rotary kiln had a diameter of 8 m and a length of 150 m, and a kiln lining was made of high alumina brick (a high-temperature resistant material). A low-temperature flue gas of the waste heat boiler had a temperature of 300° C., and a high-temperature reduction flue gas had a temperature of 1,600° C.; the cooling rotary kiln had a temperature of 1,300° C.; a CO of the fused salt electrolysis tank had a temperature of 700° C.; the raw material was preheated to 1,300° C.; and a high-temperature mixed flue gas outlet had a temperature of 1,500° C. Rutile was used as a titanium-containing raw material, with a $TiO_2$ content of 95% wt, particle size of 600 mesh, and a moisture content of 2.3% wt. Coke was used as a carbon reducing agent, with a particle size of 200 mesh, a fixed carbon content of 86% wt, and a moisture content of lower than 5% wt. The reduction rotary kiln had a rotational speed of 5 r/min, and the raw material and the reducing agent stayed in the reduction rotary kiln for 2 h.

In S2, a high-temperature air flow in the kiln had a temperature of 1,600° C., and a material discharged from the kiln had a temperature of 1,500° C.; $TiO_2$ in the titanium-containing raw material was reduced by the carbon reducing agent into titanium oxycarbide ($TiC_{0.4}O_{0.57}$) and titanium carbon oxynitride ($TiC_{0.30}O_{0.42}N_{0.28}$).

In S3, a material outlet had a temperature of 400° C., and a flue gas outlet had a temperature of 1,200° C.

In S4, silica sol was added to the titanium oxycarbide and titanium carbon oxynitride material separated by the magnetic separator, with an addition proportion of 7.5%; the molding was conducted at a pressure of 200 Mpa; the sintering furnace was a high-temperature muffle furnace; and the sintering was conducted at 1,800° C. for 2 h.

In S5, the fused salt electrolysis was conducted at a current density of 1.2 $A/cm^2$; a cathode material was copper; the fused salt was a composition of NaCl, KCl, and $CaCl_2$, where the NaCl, KCl, and $CaCl_2$ had mass proportions of 50%, 30%, and 20%, respectively; and the fused salt electrolysis was conducted at a temperature of 700° C.

The remaining conditions were the same as in Example 1. The production capacity of this example of the present disclosure was as follows: titanium-containing raw material: 6.3 t/h, carbon reducing agent: 4.1 t/h, and prepared titanium: 3.5 t/h. Elemental analysis results of the obtained titanium were as follows: Ti: 99.52%, C: 0.06%, O: 0.20%, and Fe: 0.21%. 4,800 kWh of electricity was recovered per hour during the power generation by waste heat.

The above examples are merely preferred examples of the present disclosure and are not intended to limit the present disclosure, and various changes and modifications may be made to the present disclosure by those skilled in the art. Any modifications, equivalent substitutions, improvements, etc. made within the spirit and scope of the present disclosure should be included within the protection scope of the present disclosure.

What is claimed is:

1. An energy-saving system for extracting titanium, comprising a raw material predrying kiln, a preheating kiln, a reduction rotary kiln, a cooling rotary kiln, a ball mill, a magnetic separator, a reduced iron powder drying kiln, a blank prefabricator, a blank drying kiln, a sintering furnace, a fused salt electrolysis tank, a titanium cleaning device, a filtering device, a vacuum dryer, a waste heat boiler, and a steam turbine generator, wherein an outlet of the raw material predrying kiln communicates with a top inlet of the preheating kiln;

a bottom outlet of the preheating kiln communicates with a kiln tail of the reduction rotary kiln;

an outlet at a kiln head of the reduction rotary kiln communicates with an inlet at a kiln tail of the cooling rotary kiln;

an outlet at a kiln head of the cooling rotary kiln is connected to the ball mill, the magnetic separator, the blank prefabricator, the blank drying kiln, the sintering furnace, the fused salt electrolysis tank, the titanium cleaning device, the filtering device, and the vacuum dryer in sequence;

the reduced iron powder drying kiln communicates with an iron powder discharge port of the magnetic separator;

a CO outlet of the fused salt electrolysis tank communicates with a CO inlet of the preheating kiln;

a flue gas outlet of the preheating kiln communicates with a flue gas inlet of the waste heat boiler;

a steam outlet of the waste heat boiler communicates with a steam inlet of the steam turbine generator;

a flue gas outlet of the waste heat boiler communicates with flue gas inlets of the raw material predrying kiln, the cooling rotary kiln, the blank drying kiln, and the reduced iron powder drying kiln; and a flue gas outlet of the cooling rotary kiln communicates with a flue gas inlet of the preheating kiln.

2. The energy-saving system for extracting titanium according to claim 1, wherein the reduction rotary kiln has a diameter of 1 m to 8 m and a length of 30 m to 150 m, and a kiln lining is made of a high-temperature resistant material.

3. The energy-saving system for extracting titanium according to claim 2, wherein the reduction rotary kiln has a length of 60 m to 120 m.

4. The energy-saving system for extracting titanium according to claim 1, wherein the sintering furnace is a vacuum furnace, a graphitization furnace, a tunnel kiln, or a muffle furnace.

5. An energy-saving method for extracting titanium based on the system according to claim 1, comprising the following steps:

S1. predrying and preheating of a titanium-containing raw material, wherein S1 specifically comprises:

adding the titanium-containing raw material and a carbon reducing agent to an inlet at a kiln tail of the raw material predrying kiln, and synchronously introducing a low-temperature flue gas of 150° C. to 300° C. from the waste heat boiler into a kiln head of the raw material predrying kiln, wherein the titanium-containing raw material and the low-temperature flue gas flow in opposite directions in the raw material predrying kiln;

predrying the titanium-containing raw material to a moisture content of less than 5% wt;

transferring the titanium-containing raw material after predrying into the top inlet of the preheating kiln, and synchronously introducing a high-temperature mixed flue gas from downstream into a bottom of the preheating kiln, wherein the high-temperature mixed flue gas is at least one selected from the group consisting of a high-temperature reduction flue gas of 1,100° C. to 1,600° C. from the reduction rotary kiln, a flue gas of 600° C. to 1,300° C. obtained after cooling and heating of the cooling rotary kiln, and a CO of 400° C. to 700° C. from the fused salt electrolysis tank;

supplementing air to burn out carbon and/or CO in the flue gas and release chemical heat, wherein the titanium-containing raw material and the high-temperature mixed flue gas flow in opposite directions; and preheating the titanium-containing raw material to 600° C. to 1,300° C.; wherein an outlet of the high-temperature mixed flue gas has a temperature of 700° C. to 1,500° C.;

wherein the titanium-containing raw material is one selected from the group consisting of high-titanium slag, rutile, artificial rutile, titanium dioxide, titanium concentrate, leucoxene, and anatase; and the carbon reducing agent is one selected from the group consisting of coal, petroleum coke, coke, and graphite;

S2 reduction of the titanium-containing raw material, wherein S2 specifically comprises:

transferring the titanium-containing raw material after preheating into the kiln tail of the reduction rotary kiln, and injecting a pulverized coal fuel and air at the kiln head of the reduction rotary kiln to form a high-temperature air flow of 1,100° C. to 1,600° C. in the reduction rotary kiln;

driving the titanium-containing raw material to slowly move towards the kiln head of the reduction rotary kiln through a rotation of the reduction rotary kiln, wherein the titanium-containing raw material is gradually heated by radiation of the high-temperature air flow, $TiO_2$ in the titanium-containing raw material is reduced by the carbon reducing agent into titanium oxycarbide ($TiC_xO_y$, $0<x$, $y<1$) and titanium carbon oxynitride ($TiC_xO_yN_z$, $0<x$, $y$, $z<1$), and by-products are reduced iron powder and CO;

transferring a solid material into the cooling rotary kiln, wherein the solid material at a material outlet of the cooling rotary kiln has a temperature of 1,000° C. to 1,500° C.; and introducing the CO produced during the reaction into the preheating kiln along with a flue gas;

S3. cooling of the solid material, wherein S3 specifically comprises:

transferring the solid material of 1,000° C. to 1,500° C. into the kiln tail of the cooling rotary kiln, and synchronously introducing the low-temperature flue gas of 150° C. to 300° C. from the waste heat boiler into the kiln head of the cooling rotary kiln to cool the solid material, wherein the material outlet has a temperature of 250° C. to 400° C. and a flue gas outlet has a temperature of 700° C. to 1,200° C.;

S4. sinter molding of a fused salt electrolysis anode, wherein S4 specifically comprises:

mixing the solid material after cooling with water to obtain a resulting mixture, and milling the resulting mixture in the ball mill to a particle size of 100 to 800 mesh to obtain a milled material;

transferring the milled material into the magnetic separator to separate the reduced iron powder, and transferring the reduced iron powder into the reduced iron powder drying kiln to obtain a by-product reduced iron powder;

subjecting the remaining titanium oxycarbide and titanium carbon oxynitride material to compression molding in the blank prefabricator to obtain a fused salt electrolysis anode blank, and drying the fused salt electrolysis anode blank in the blank drying kiln for 4 h to 12 h, wherein the reduced iron powder drying kiln and the blank drying kiln use the low-temperature flue gas of 150° C. to 300° C. from the waste heat boiler for drying; and sintering the fused salt electrolysis anode blank after drying in the sintering furnace to obtain the fused salt electrolysis anode, wherein there is no oxygen in the sintering furnace, and the sintering is conducted at 800° C. to 1,800° C. for 2 h to 12 h;

S5. preparation of titanium by fused salt electrolysis, wherein S5 specifically comprises:

electrolyzing the fused salt electrolysis anode obtained from sinter molding in the fused salt electrolysis tank, wherein the fused salt electrolysis anode is dissolved to obtain $Ti^{2+}$, $Ti^{3+}$, and CO;

discharging anode impurities from the fused salt electrolysis tank in the form of anode slime;

introducing the CO of 400° C. to 700° C. into the preheating kiln for recycling, wherein titanium is separated at a metal cathode from the $Ti^{2+}$ and $Ti^{3+}$;

cooling the titanium to below 150° C., cleaning in the titanium cleaning device to remove entrained inorganic salts;

filtering out the titanium in the filtering device; and drying in the vacuum dryer to obtain a titanium product.

6. The energy-saving method for extracting titanium according to claim 5, wherein in S1, the titanium-containing raw material has a particle size of 80 to 600 mesh, a $TiO_2$ content of more than 30% wt, and a moisture content of less than 10% wt; and the carbon reducing agent has a particle size of 10 to 200 mesh, a fixed carbon content of more than 70% wt, and a moisture content of less than 10% wt.

7. The energy-saving method for extracting titanium according to claim 5, wherein in S2, the reduction rotary kiln has a rotational speed of 0.2 r/min to 5 r/min, and the titanium-containing raw material and the carbon reducing agent stay in the reduction rotary kiln for 2 h to 12 h.

8. The energy-saving method for extracting titanium according to claim 5, wherein in S4, the titanium oxycarbide and titanium carbon oxynitride material separated by the magnetic separator are added with one or a combination of two or more from the group consisting of sodium carboxymethyl cellulose (CMC-Na), polyacrylic acid (PAA), aluminum dihydrogen phosphate, silica sol, and aluminum sol, with an addition proportion of 0.5% wt to 15% wt.

9. The energy-saving method for extracting titanium according to claim 5, wherein in S4, the compression molding for the fused salt electrolysis anode blank is conducted at a pressure of 20 MPa to 200 MPa, and the fused salt electrolysis anode blank has a granular, plate or cylindrical shape.

10. The energy-saving method for extracting titanium according to claim 5, wherein in S5, the fused salt electrolysis is conducted at a current density of 0.05 $A/cm^2$ to 1.2 $A/cm^2$; a material of the metal cathode is titanium, titanium alloy, carbon steel, stainless steel, aluminum, aluminum alloy, chromium, molybdenum, magnesium, or copper; a fused salt comprises one or a combination of two or more from the group consisting of LiCl, NaCl, KCl, $MgCl_2$, and $CaCl_2$); and the fused salt electrolysis is conducted at a temperature of 400° C. to 700° C.

11. The energy-saving method for extracting titanium according to claim 5, wherein the reduction rotary kiln has a diameter of 1 m to 8 m and a length of 30 m to 150 m, and a kiln lining is made of a high-temperature resistant material.

12. The energy-saving method for extracting titanium according to claim 11, wherein the reduction rotary kiln has a length of 60 m to 120 m.

13. The energy-saving method for extracting titanium according to claim 5, wherein the sintering furnace is a vacuum furnace, a graphitization furnace, a tunnel kiln, or a muffle furnace.

* * * * *